US005654100A

United States Patent [19]

Köbler et al.

[11] Patent Number: 5,654,100

[45] Date of Patent: Aug. 5, 1997

[54] OFFSET RUBBER-BLANKET SLEEVE

[75] Inventors: Ingo Köbler, Diedorf; Eduard Hoffmann, Bobingen; Wolfgang Prem, Ustersbach, all of Germany

[73] Assignee: MAN Roland Druckmaschinen AG, Offenbach am Main, Germany

[21] Appl. No.: 656,101

[22] Filed: May 31, 1996

Related U.S. Application Data

[63] Continuation of Ser. No. 404,116, Mar. 14, 1995, abandoned , which is a continuation of Ser. No. 119,414, Sep. 9, 1993, abandoned .

[30] Foreign Application Priority Data

Sep. 11, 1992 [DE] Germany ..... 42 30 431.8

[51] Int. Cl.[6] ..... D02G 3/00

[52] U.S. Cl. ..... 428/390; 428/365; 428/375; 428/382; 428/379; 428/383; 428/392; 428/902; 101/216; 101/327; 101/328; 101/348; 101/375; 101/376

[58] Field of Search ..... 428/375, 362, 428/346, 246, 224, 284, 283, 319.3, 365, 382, 379, 383, 392, 902; 29/131, 132, 451; 101/130, 376, 375, 401.1, 327, 216, 348, 328; 156/215, 287, 298, 294; 66/170

[56] References Cited

U.S. PATENT DOCUMENTS

| | | | |
|---|---|---|---|
| 1,804,139 | 5/1931 | Adsit et al. . | |
| 3,146,709 | 9/1964 | Bass | 101/375 |
| 3,632,381 | 1/1972 | Chromecek | 117/38 |
| 3,730,794 | 5/1973 | Ross et al. | 156/112 |
| 3,750,250 | 8/1973 | Brown | 29/148 |
| 3,802,952 | 4/1974 | Gurin et al. | 161/164 |
| 3,983,287 | 9/1976 | Coossen et al. | 428/241 |
| 4,043,013 | 8/1977 | Zeppernick et al. | 29/132 |
| 4,043,142 | 8/1977 | Marshall | 66/170 |
| 4,144,813 | 3/1979 | Jukan | 101/382 |
| 4,303,721 | 12/1981 | Rodriquez | 428/213 |
| 4,378,622 | 4/1983 | Pinkston et al. | 29/148.4 |
| 4,548,858 | 10/1985 | Meadows | 428/224 |
| 4,554,040 | 11/1985 | Van der Velden | 156/215 |
| 4,615,934 | 10/1986 | Ellison | 428/254 |
| 4,620,482 | 11/1986 | Fischer | 101/415.1 |
| 4,679,600 | 7/1987 | Dougherty | 138/128 |
| 4,737,210 | 4/1988 | Dougherty | 156/148 |
| 4,812,357 | 3/1989 | O'Rell et al. | 428/246 |
| 4,903,597 | 2/1990 | Hoage et al. | 101/401.1 |
| 5,116,669 | 5/1992 | Souobe | 428/250 |
| 5,205,213 | 4/1993 | Bresson | 101/217 |
| 5,351,615 | 10/1994 | Köbler et al. | 101/217 |
| 5,351,616 | 10/1994 | Gelinas et al. | 101/218 |

FOREIGN PATENT DOCUMENTS

| | | |
|---|---|---|
| 0076777 | 4/1983 | European Pat. Off. . |
| 0 173 140 | 3/1986 | European Pat. Off. . |
| 0173140 | 3/1986 | European Pat. Off. . |
| 0421145 | 4/1991 | European Pat. Off. . |
| 04 52 184 A1 | 10/1991 | European Pat. Off. . |
| 0 514344 | 11/1992 | European Pat. Off. . |
| 2542748 | 4/1976 | Germany . |
| 27 00 118 C2 | 4/1977 | Germany . |
| 2 555 233 | 6/1977 | Germany . |

*Primary Examiner*—Merrick Dixon

*Attorney, Agent, or Firm*—Cohen, Pontani, Lieberman, Pavane

[57] ABSTRACT

An offset rubber-blanket sleeve having a support sleeve in the form of a layered body. The layered body is produced from a plastic, preferably rubber, as a base material and the base material is reinforced by layer inserts embedded therein. Additionally, a rubber layer is vulcanized on the support sleeve.

7 Claims, 3 Drawing Sheets

OFFSET RUBBER-BLANKET SLEEVE

This is a continuation of application Ser. No. 08/404,116, filed Mar. 14, 1995 which is a continuation of application Ser. No. 08/119,414 filed Sep. 9, 1993, abandoned May 19, 1990–Apr. 17, 1996, respectfully.

BACKGROUND OF THE INVENTION

1. Field of the Invention

The invention relates to an offset rubber-blanket sleeve for a non-grooved rubber-blanket cylinder for applying a printed image to material in the form of sheets or webs.

2. Description of the Related Art

In offset rotary printing machines, rubber blankets are conventionally held on the rubber-blanket cylinder by mechanical fastenings. Such a rubber-blanket cylinder has an axially extending groove with clamping segments in which the opposite ends of the rubber blanket are fastened. In such a clamping mechanism, a clamping groove is formed in the body of the rubber-blanket cylinder and extends axially in segments along the width of the cylinder. This clamping groove forms an interruption in the cylindrical outer surface area of the rubber-blanket cylinder so that a pressure-free or print-free zone occurs during the rolling movements of the rubber-blanket cylinder. Because of the groove, bending vibrations are induced in the cylinders which roll on one another. This has a negative impact on printing quality.

To overcome these difficulties, rubber-blanket sleeves for a rubber-blanket cylinder without a cylinder groove have already been developed. For example, a rubber-blanket sleeve is known from the German Patent 27 00 118 C2 in which a continuous coating of elastic material, preferably rubber, is arranged on an exchangeable carrier or support sleeve of plastic or metallic material. The rubber coating is applied to the support sleeve so as to be completely free of gaps and seams. The rubber-blanket sleeve produced in this way is then slid over the rubber-blanket cylinder by means of compressed air and fixed thereon by cutting off the air supply.

In order that the rubber-blanket sleeve remains fixed in a stationary manner on the rubber-blanket cylinder during the printing process, this rubber-blanket sleeve is under-dimensioned and is widened by placement on the rubber-blanket cylinder so that the rubber-blanket sleeve is held by the joining pressure between the outer surface area of the rubber-blanket cylinder and the inside of the sleeve. The rubber-blanket sleeve must therefore be capable of absorbing considerable peripheral or circumferential forces. For this reason, the known rubber-blanket sleeve is constructed from a support sleeve having a high modulus of elasticity and a compressible rubber coating which cannot by itself absorb the high circumferential forces.

Nevertheless, such a support sleeve is comparatively very expensive since materials such as nickel, steel or fiberglass-reinforced plastic are preferably used to achieve the required characteristics.

SUMMARY OF THE INVENTION

Accordingly, it is an object of the present invention to provide an inexpensive rubber-blanket sleeve which can absorb high circumferential forces and satisfies all the requirements of the known rubber-blanket sleeve when placed on the rubber-blanket cylinder.

Pursuant to this object, and others which will become apparent hereafter, one aspect of the present invention resides in a support sleeve constructed in the form of a sandwich or layer body whose base material is plastic, preferably rubber, and which is reinforced by layer inserts embedded therein. A rubber layer is vulcanized onto the support sleeve.

These layer inserts can be produced from steel, textile fibers or synthetic fibers and form a braid which is embedded in the—preferably rubber—base material of the support sleeve for reinforcement thereof. The sleeve itself can be manufactured rotatively, that is so as to be continuous, but can also be produced in the planar state and then welded to form a sleeve.

Due to such a reinforcement, that is by embedding a braid in the base material of the support sleeve, the plastic, preferably rubber, having a weak modulus of elasticity can absorb substantially greater circumferential forces and, accordingly, expensive support sleeve of fiberglass-reinforced plastic or metallic material can be dispensed with.

Such a rubber-blanket sleeve is conventionally under-dimensioned in the relaxed state compared with the rubber-blanket cylinder carrying it and can be expanded by means of compressed air so as to be slipped onto the rubber-blanket cylinder and fixed on the circumference of the rubber-blanket cylinder by means of pressing forces when cutting off the compressed air.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
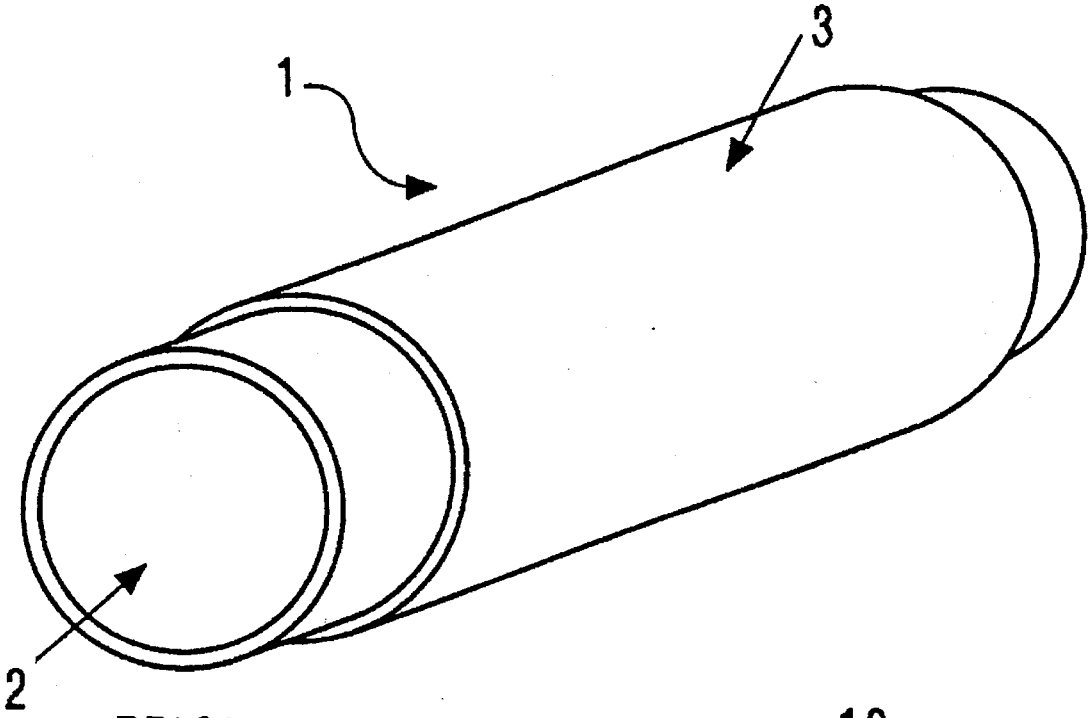
PRIOR ART FIG.1
FIG. 1 depicts a conventional rubber-blanket sleeve with support sleeve and vulcanized rubber coating.

FIG. 1 shows a known rubber-blanket sleeve 1 which has a support sleeve 2 of nickel, steel or fiberglass-reinforced plastic. A rubber blanket 3 in the form of a rubber coating is vulcanized onto this support sleeve 2. This rubber-blanket sleeve 1 has a continuous outer and inner surface which is free of gaps. The sleeve 1 can be arranged on the outer circumferential surface of a rubber-blanket cylinder so as to be removable. Since the outer circumferential surface of the sleeve 1 is continuous and free of gaps, a rolling contact is achieved between the rubber blanket 3 and the ink-transferring surfaces of a plate cylinder, not shown, without shocks or vibrations.

Figure 2:
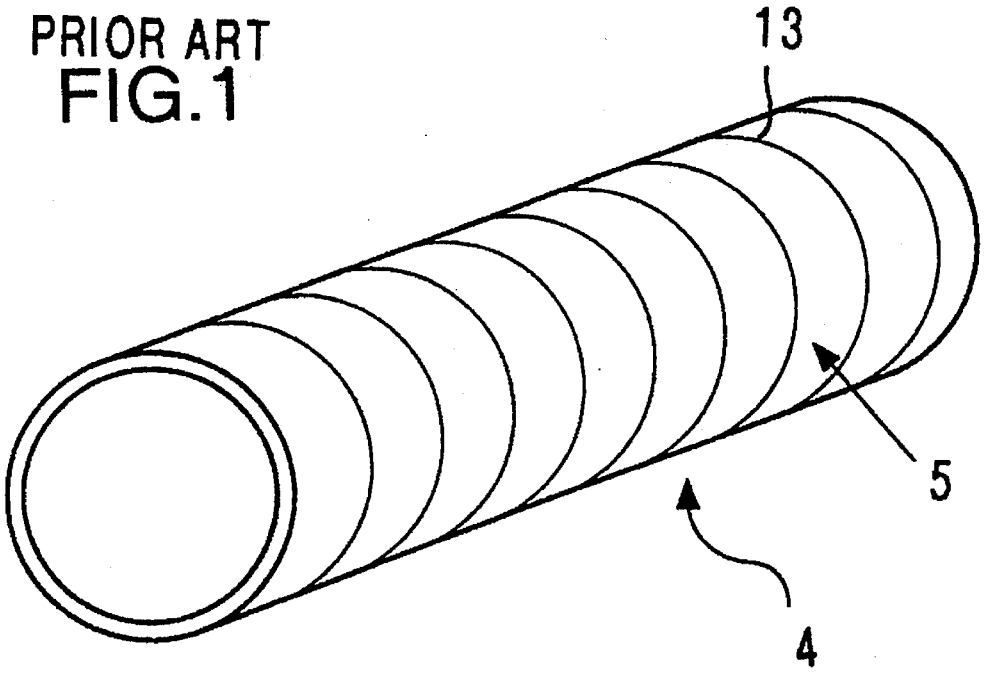
FIG. 2 shows a reinforcement of the support sleeve of a rubber-blanket sleeve according to the present invention.

On the other hand, FIG. 2 shows a support sleeve 4 in the form of a layered body 5 with reinforcement provided by layer inserts 13 in the form of a spiral winding which is embedded in the base material, preferably rubber, of the support sleeve 4.

Figure 3:
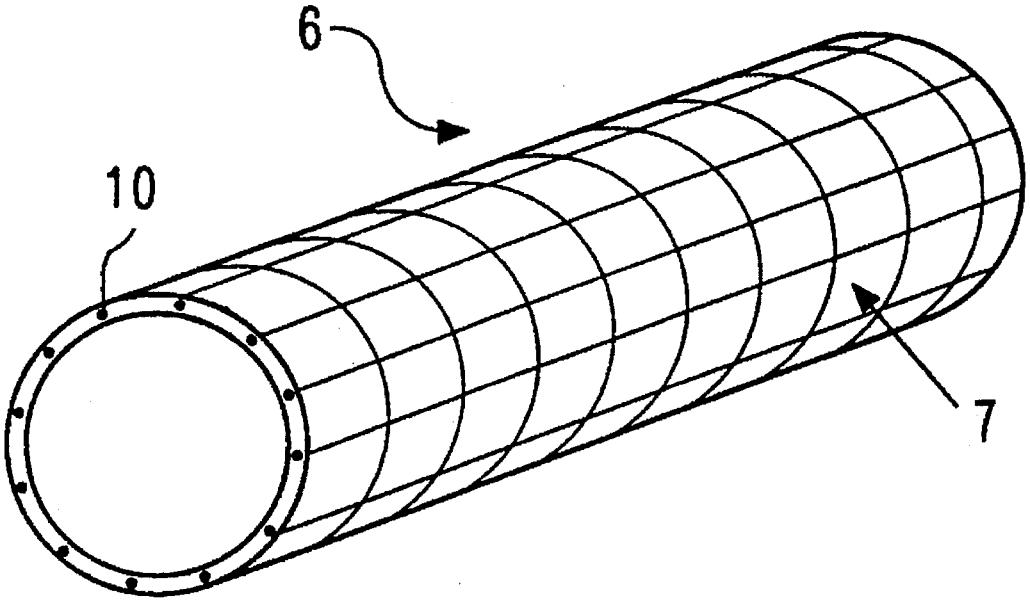
FIG. 3 is a view similar to FIG. 2 of a second embodiment of the invention.
Figure 4:
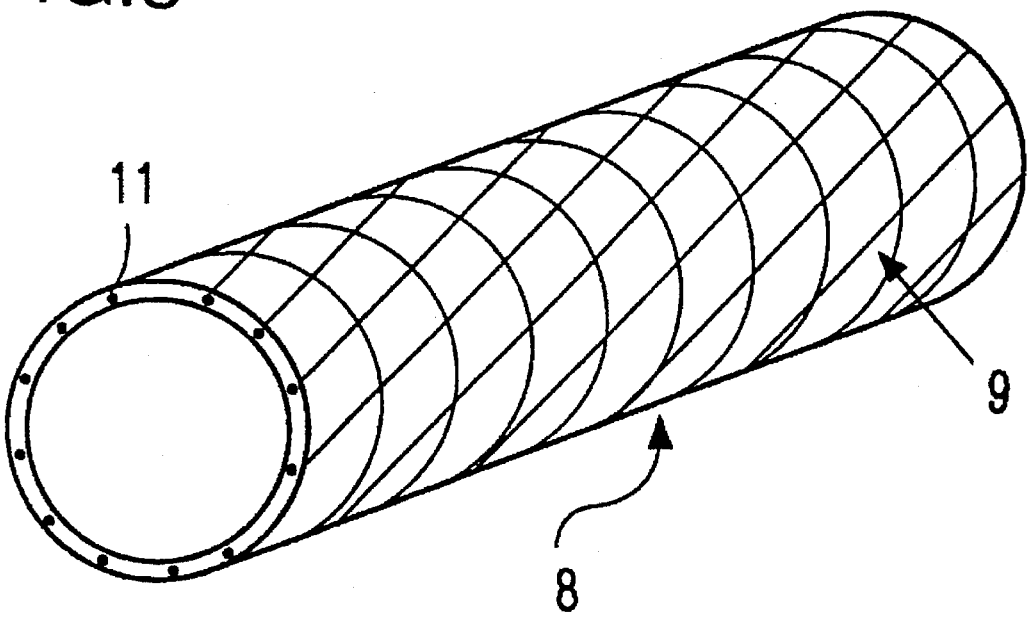
FIG. 4 is a view similar to FIG. 2 of a third embodiment of the invention.

Other embodiments are shown respectively in FIGS. 3 and 4. The reinforcement 10 and 11, respectively, of the base material of the support sleeve 6 and 8, according to the invention, can also be constructed in the form of an interwoven braid 7 or in the form of a cross-winding 9.

Like the support sleeves 4, 6, 8, all of the rubber-blanket sleeves according to the invention have all of the described functions of the known rubber-blanket sleeve 1.

Figure 5:
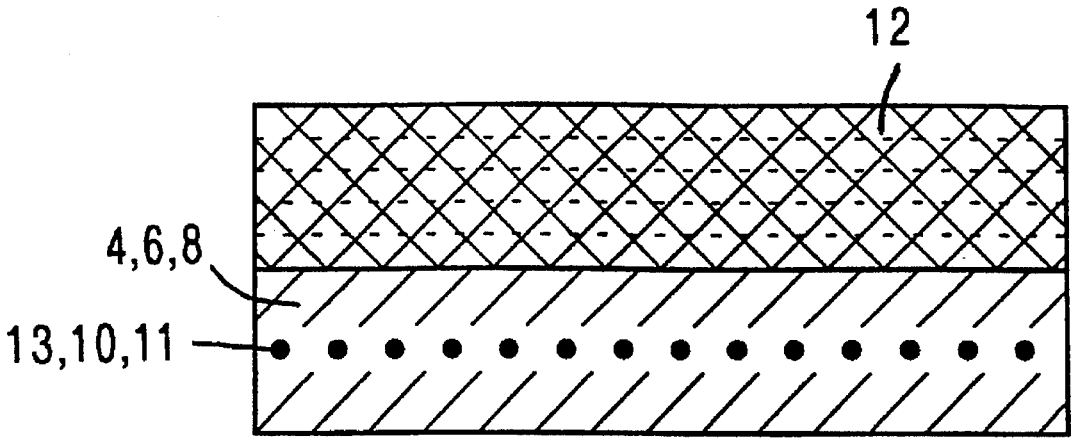
FIG. 5 illustrates the layer construction of a rubber-blanket sleeve according to the invention.

FIG. 5 shows the overall layer construction of the rubber-blanket sleeve with the support sleeve 4, 6 or 8, the reinforcement 10, 11, 13, and a rubber coating 12 vulcanized onto the support sleeve.

The invention is not limited by the embodiments described above which are presented as examples only but can be modified in various ways within the scope of protection defined by the appended patent claims.

We claim:

1. An offset rubber-blanket sleeve for a groove-less rubber-blanket cylinder, comprising:

a support sleeve layer consisting of rubber material and inserts, having a higher modulus of elasticity than the rubber material, embedded within said rubber material so as to reinforce said support sleeve; and, a rubber layer vulcanized onto an outer surface of said support sleeve layer.

2. An offset rubber-blanket sleeve according to claim 1, wherein said inserts are made of steel.

3. An offset rubber-blanket sleeve according to claim 1, wherein said inserts are made of textile fibers.

4. An offset rubber-blanket sleeve according to claim 1, wherein said inserts are made of synthetic fibers.

5. An offset rubber-blanket sleeve according to claim 1, wherein said inserts are in the form of a spiral winding.

6. An offset rubber-blanket sleeve according to claim 1, wherein said inserts are formed as an interwoven braid.

7. An offset rubber-blanket sleeve according to claim 1, wherein said sleeve is a cross-winding embedded in rubber.

* * * * *